United States Patent [19]

James

[11] 4,010,475

[45] Mar. 1, 1977

[54] ANTENNA ARRAY ENCASED IN DIELECTRIC TO REDUCE SIZE

[75] Inventor: James Roderick James, Swindon, England

[73] Assignees: The Plessey Company Limited; Plessey Handel und Investments A.G., both of Essex, England

[22] Filed: Aug. 7, 1975

[21] Appl. No.: 602,724

Related U.S. Application Data

[63] Continuation-in-part of Ser. No. 478,622, June 12, 1974, Pat. No. 3,924,238.

[52] U.S. Cl. ..... 343/830; 343/834; 343/873

[51] Int. Cl.² ..... H01Q 1/40

[58] Field of Search ..... 343/807, 818, 802, 872, 343/873, 830, 834

[56] References Cited

UNITED STATES PATENTS

| | | | |
|---|---|---|---|
| 956,489 | 4/1910 | Fessenden | 343/755 |
| 2,417,808 | 3/1947 | Carter | 343/833 |
| 2,567,260 | 9/1951 | Wiley | 343/802 |
| 2,611,869 | 9/1952 | Willoughby | 343/873 |
| 2,841,792 | 7/1958 | Edson et al. | 343/819 |
| 3,392,396 | 7/1968 | Ehrenspeck | 343/819 |
| 3,490,026 | 1/1970 | Kolbe et al. | 343/833 |

*Primary Examiner*—Eli Lieberman
*Attorney, Agent, or Firm*—Scrivener Parker Scrivener & Clarke

[57] ABSTRACT

Constructions for radio antennae, whose size is made appreciably less than the size of conventional antennae by using the dielectric properties of a mixture of barium titanate and strontium titanate.

2 Claims, 4 Drawing Figures

ANTENNA ARRAY ENCASED IN DIELECTRIC TO REDUCE SIZE

This is a continuation-in-part of application, Ser. No.: 478,622, filed June 12, 1974, now U.S. Pat. No. 3,924,238.

This invention relates to radio antennae with particular but not exclusive reference to antennae suitable for use in the UHF or VHF ranges.

According to the invention there is provided a radio antenna comprising an active monopole, a reflector monopole and at least one director monopole, and lowloss high-permittivity dielectric material surrounding the active monopole and each of the director monopoles.

The invention will now be described with reference to the accompanying drawings in which.

Figure 1:
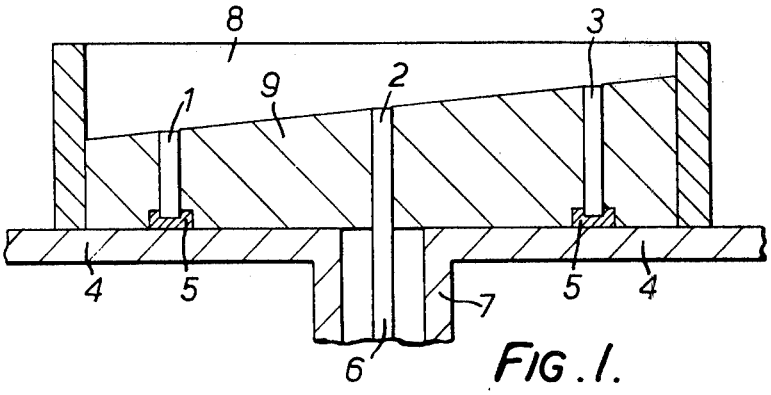
FIG. 1 is a sectional elevation of an antenna according to the invention.

The antenna comprises three parallel conductive rods 1, 2, 3 rising perpendicular to a conductive ground plate 4. The rod 1 rises less and the rod 3 more than does the central rod 2. The rods 1, 3 are supported from the ground plate 4 by insulating mountings 5, and serve respectively as a director monopole and a reflector monopole. The central rod 2 is connected to, or formed as the projecting end of, the core 6 of a coaxial cable, over which signals are passed to or from the rod 2. The rod 2 serves as the active monopole. The sleeve 7 of the coaxial cable is connected to the ground plate 4. The rods 1, 2, 3 are enclosed in a container 8. In the container 8, dielectric material 9 covers the ground plate 4 and rises to the free ends of the rods 1, 2, 3.

The dielectric material 9 is a mixture of barium titanate and strontium titanate. The mixture may be in powder form. Conveniently the container 8 is made of polyacrylate insulating material. If the dielectric material 9 is in bulk as opposed to powder form, the container 8 may be unnecessary.

Figure 3:
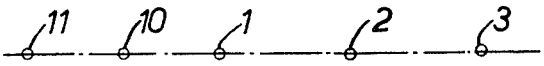
FIG. 3 is a diagram illustrating the positions of additional director monopoles.

If desired, additional director monopoles 10, 11 may be provided in line with the monopoles 1, 2, 3 as shown in FIG. 3. In this event, the container 8 is lengthened in order to accommodate the dielectric material which surrounds the additional monopoles.

Figure 4:
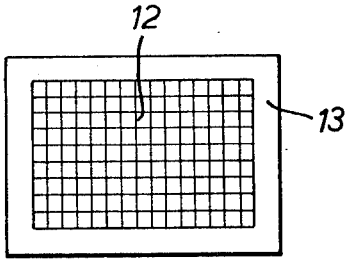
FIG. 4 shows an alternative construction of a reflector monopole.

If desired, the reflector rod 3 may be replaced by a grid 12 (FIG. 4) of conductive wires. The grid 12 is mounted on a rectangular frame 13 which is insertable into a pair of opposed slots 14 (FIG. 2) in the walls of the container 8. In this event, it is not necessary to provide dielectric material on the side of the grid 12 which is remote from the central rod 2. If such dielectric material is not provided, the grid 12 is effectively the end wall of the container 8.

By using dielectric material it is possible to make an appreciable reduction in the length of a monopole, as compared with conventional antennae, without substantially altering the electrical characteristics. The reduction depends inversely on the square root of the dielectric constant, relative to free space, of the dielectric material. Similar reductions are obtainable with dipole antennae, and in the spacing of poles in antennae having a plurality of spaced poles.

Figure 2:
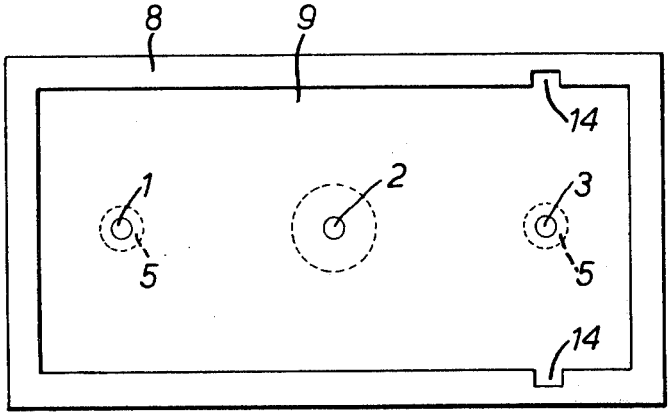
FIG. 2 is a plan of the antenna of FIG. 1.

Resonance at the operating frequency of an antenna can be obtained if the antenna dimensions conform to the equation:

$$J_1(k_2b)\cdot Y_o(k_2a) = J_o(k_2a)\cdot Y_1(k_2b)$$

where $a$, $b$ are the radii of the conductive rod 2, and the surrounding dielectric material 9 respectively, (see FIGS. 1, 2); $J_o$, $J_1$, $Y_o$ $Y_1$ indicate Bessel functions according to accepted mathematical notation; and $k_2$ is read and equal to $k\ \sqrt{1-(1/x)^2}$ In evaluating $k_2$, $$k = \frac{2\pi\sqrt{L}}{\lambda_0}$$

and $x$ is derived from $L = x.m\lambda_0 \div 4\ \sqrt{B}$

B being the relative dielectric constant of the dielectric material; L being the length of a monopole antenna; $\lambda_0$ being the free space wave length of radio waves at the desired frequency; and $m$ is an integer.

Practical dimensions, obtained from the foregoing formulae, generally require a dielectric material whose permittivity is at least 4. In general, acceptable dimensions are obtainable if the product of the frequency at which the antenna is to work and the square root of the dielectric constant of the dielectric material is equal to or greater than $5 \times 10^9$. A preferred range of value of the dielectric constant is from 100 to 10,000. The term "high permittivity" used herein is used to mean permittivities of the value 4 or more.

It is to be understood that the foregoing description of specific examples of this invention is made by way of example only and is not to be considered as a limitation in its scope.

What is claimed is:

1. A radio antenna comprising an active monopole a reflector monopole and at least one director monopole, and low-loss high-permittivity dielectric material surrounding the active monopole and the director monopole, the reflector monopole including a grid of conductive wires, and providing a closure wall for the dielectric material.

2. A radio antenna comprising three monopoles, a central one of which is the projecting end of a core of a coaxial cable, and the other two of which are parallel to said central one and are spaced therefrom in opposite directions, one of the two being shorter and the other longer than the central monopole; the antenna also having a container containing dielectric material which surrounds each monopole, the dielectric material being a mixture of barium titanate and strontium titanate, the longest monopole being in the form of a grid of conductive material.

* * * * *